United States Patent [19]

Storey

[11] Patent Number: 4,559,863

[45] Date of Patent: Dec. 24, 1985

[54] VALVE FOR A HYDRAULIC RAM

[75] Inventor: Robert B. Storey, Stowmarket, England

[73] Assignee: BSP International Foundations Limited, Suffolk, England

[21] Appl. No.: 580,555

[22] Filed: Feb. 14, 1984

[30] Foreign Application Priority Data

Feb. 19, 1983 [GB] United Kingdom ..... 8304691

[51] Int. Cl.[4] ..... F15B 13/042

[52] U.S. Cl. ..... 91/165; 91/468; 91/469; 92/134

[58] Field of Search ..... 92/134; 91/165, 166, 91/300, 276, 468, 469

[56] References Cited

U.S. PATENT DOCUMENTS

| | | | |
|---|---|---|---|
| 1,636,651 | 7/1927 | Smith, Jr. | 91/300 |
| 1,895,153 | 1/1933 | Feucht | 91/300 |
| 3,965,799 | 6/1976 | Juvonen et al. | 91/276 |
| 4,028,995 | 6/1977 | Salmi et al. | 91/300 |

*Primary Examiner*—Paul E. Maslousky

*Attorney, Agent, or Firm*—Wenderoth, Lind & Ponack

[57] ABSTRACT

A spool valve for use in a hydraulic ram includes a piston journalled for axial movement within a cylinder under the influence of a fluid fed under pressure to the cylinder. The spool valve is journalled within a valve block closing an end of the cylinder through which passes a piston rod. The valve is biased from one position to another by means of differential areas of a circumferential groove around the spool and by applying fluid to a chamber at one end of the spool.

9 Claims, 1 Drawing Figure

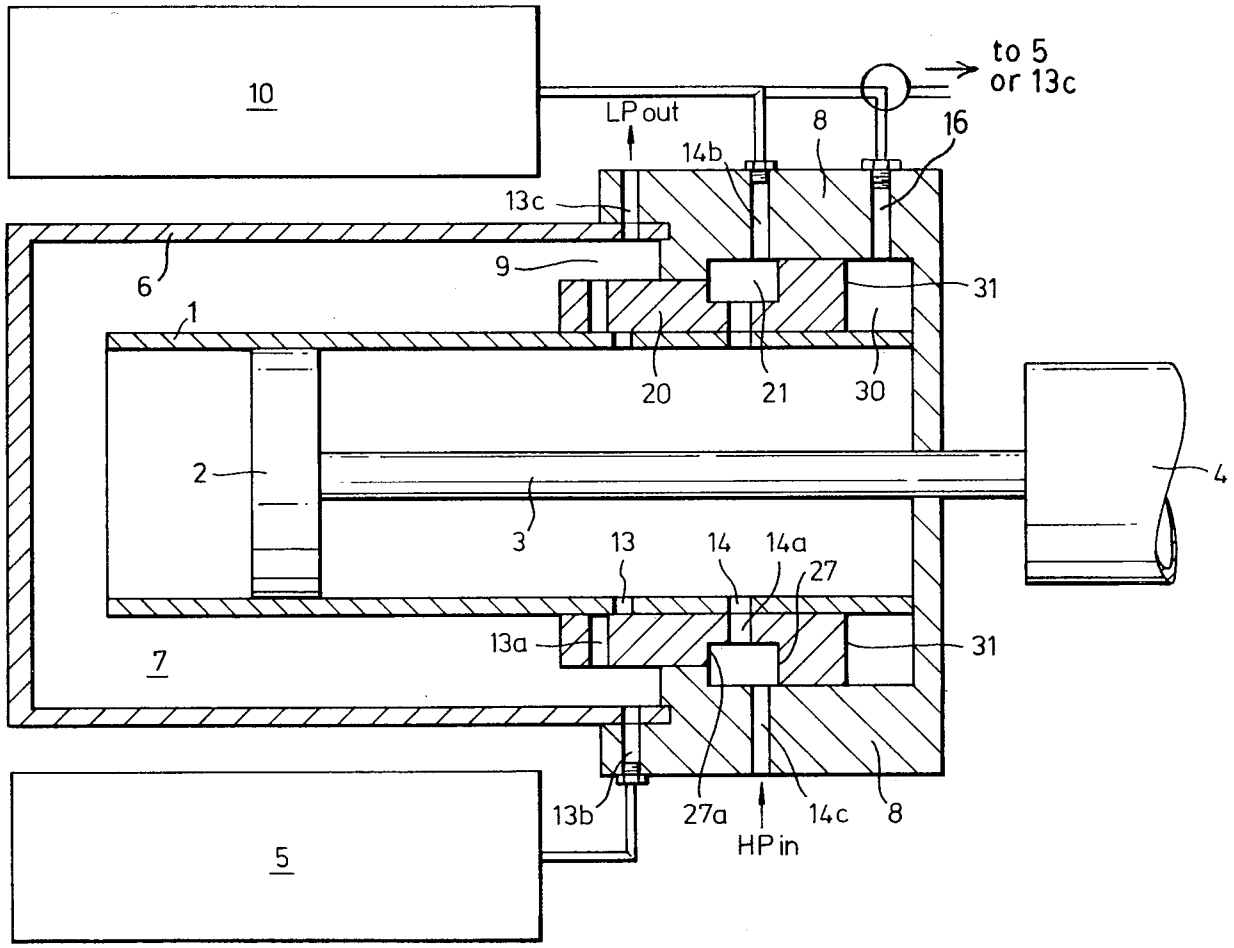
to 5
or 13c
16
8
14b
LP out
13c
10
31
30
21
20
9
6
1
2
4
3
31
27
14a
14
13
13a
7
8
14c
HP in
27a
13b
5

VALVE FOR A HYDRAULIC RAM

BACKGROUND OF THE INVENTION

The present invention relates to a valve for an hydraulic ram, notably to a pile driver incorporating such a valved ram for moving the hammer of the pile driver.

In an hydraulic ram, as used in a pile driver, fluid must flow rapidly into and out of the ram cylinder in synchrony with the operation of the hammer. In order to achieve this flow, it has been proposed to use a spool valve. The spool is moved axially by applying fluid at pressure to one side or the other of the valve. However, this requires the use of extra fluid lines to feed fluid to the valve and complex sealing arrangements which are costly and cumbersome.

SUMMARY OF THE INVENTION

The present invention provides a form of spool valve which reduces these problems and offers the advantage that it is possible to construct a more compact and shorter valve assembly, thus saving on construction costs.

Accordingly, the present invention provides an hydraulic ram comprising a piston journalled for axial movement within a cylinder under the influence of a fluid fed under pressure to the cylinder via a valving means, which valving means is adapted to place the cylinder in fluid flow communication with the fluid under pressure and to permit release of fluid from the cylinder upon completion of the stroke of the piston within the cylinder. The valving means comprises a spool member slideably mounted within the ram and having ports therein adapted to register with co-operating ports in the cylinder wall upon axial movement of the spool member, the spool member being formed with a circumferential recess therein which is adapted at substantially all positions of the spool member to be in fluid flow communication with an inlet port for fluid under pressure, there being formed at the end of the spool member a chamber adapted to be in fluid flow communication with fluid under pressure or with an environment at lower pressure whereby fluid under pressure can act on the end face of the spool member. The effective radial area of the end face of the spool member exposed to the fluid is greater than the difference in effective radial areas of the two radial side walls of the circumferential recess. The effective radial area of that side wall adjacent the end wall of the spool member is greater than the effective radial area of the other side wall of the recess, whereby application of fluid under pressure to the recess is adapted to cause the spool member to move axially with respect to the chamber, and application of fluid under pressure to the chamber is adapted to cause the spool member to move axially in the opposite direction.

Preferably, the spool member is in the form of a sleeve member which is slideably journalled upon the cylinder, notably upon the outer face of the cylinder wall, and the ports are all substantially radially orientated.

The invention also provides a pile driver in which the hammer is reciprocated by an hydraulic ram of the invention.

BRIEF DESCRIPTION OF THE DRAWING

To aid understanding of the invention it will be described by way of reference to a preferred form thereof as shown in the accompanying drawing which is a diagrammatic section through a ram.

DETAILED DESCRIPTION OF THE INVENTION

The ram comprises a conventional cylinder 1 and piston 2. The piston carries a substantially co-axial piston rod 3, which extends therefrom and through a glanded opening in an end wall of the cylinder 1. The rod 3 carries the hammer weight 4 of the pile driver. The other, upper end of the cylinder is open to, or has ports in communication with, a fluid return means for passing fluid displaced by the upward movement of the piston in the cylinder to a low pressure accumulator 5. Conveniently, the fluid return means takes the form of a sleeve 6 surrounding the cylinder 1 so as to form a substantially annular duct 7 surrounding and substantially co-axial with the cylinder 1. The upper, open ends of the cylinder 1 and the sleeve 6 are closed by a transverse wall.

The accumulator 5 typically comprises a steel or other pressure vessel having a compressible section thereto. As fluid is fed into the vessel, the compressible section is compressed so as to store energy therein. This stored energy causes the section to re-expand when the pressure on the accumulator drops and this aids rapid expulsion of the fluid from the vessel to the cylinder during the fall stroke of the piston. The compressible section can, for example, be a gas filled bladder which is collapsed or a diaphragm or bellows wall which is distended.

At the foot of cylinder 1 and sleeve 6 is a valve block 8 which serves to close the basal end of cylinder 1 and the annular duct 7. Block 8 has an internal circumferential recess or gallery 9 communicating with annular duct 7 so that low pressure fluid can flow to and from the duct via the gallery and a radial port **13*b* in the valve block wall from or into the low pressure accumulator 5 during the downward or upward strokes of the piston. The cylinder wall has radial ports 13 therethrough whereby fluid can flow from the cylinder space below piston 2 into gallery 9** during the downward stroke of the piston.

The cylinder wall also has radial ports 14 therethrough axially lower than ports 13, whereby fluid at high pressure can flow from a high pressure accumulator 10 and from a pumped supply (not shown) into the cylinder space under the piston for the lift stroke of the piston. The valve block 8 has radial ports **14*b* and 14*c* co-operating with ports 14** and connected to the accumulator and pump means respectively.

Journalled in sliding, sealing engagement upon the outer wall of cylinder 1 and within the valve block 8 is an axially moveable sleeve 20. This sleeve has axially spaced radial ports **13*a* and 14*a* which register with respectively ports 13 in one axial position of sleeve 20 upon the cylinder 1; and with ports 14 in another axial position of the sleeve. On the outer face of sleeve 20 is a circumferential gallery or groove 21 which communicates with one or more radial ports 14*a* through the sleeve. The ports 14*a* co-operate with ports 14*b* and 14*c* through the wall of the valve block 8 to allow fluid to flow into the cylinder space under the piston. Gallery 21 extends axially for such a distance that it is in communication with ports 14*b* and 14*c* in the valve block 8 at all axial positions of the sleeve 20** during operation of the valve assembly.

The high pressure accumulator 10 is preferably of similar construction to accumulator 5. Accumulator 10 can be fed directly with high pressure fluid from a pump (not shown). However, it is preferred to feed high pressure fluid from the pump via port 14*c*, gallery 21 and port 14*b* so that high pressure fluid can be fed from both ports 14*b* and 14*c* via ports 14 to the cylinder on the lift stroke of the piston.

Sleeve 20 extends beyond port 14 through the valve block wall, but not to the full extent of the interior of valve block 8, so that there is formed an annular chamber 30 at the foot of the sleeve. This chamber is bounded by the end wall 31 of sleeve 20, the outer wall of the cylinder 1, the end wall of the valve block and the inner surface of the side wall of the valve block. A port 16 is provided through the wall of valve block 8 into the chamber 30, whereby fluid at the same pressure as is fed to ports 14*b* and 14*c* can be fed simultaneously to chamber 30, e.g. by means of a branch in the line feeding fluid to port 14*c*. Alternatively, a duct or line transfers fluid from port 14*b* to port 16 via a valve (not shown). Preferably, this valve is a two position valve which puts port 16 into communication with port 14*b* to feed high pressure fluid to chamber 30 to initiate the lift stroke of the piston; or puts port 16 into communication with port 13*c* to allow the pressure in chamber 30 to be released to initiate the downward stroke cycle of the piston. It is also preferred that the valve be spring biassed into communication with port 13*c* so that, if the valve or the high pressure fluid feed fails, the valve will automatically adopt the position in which the hammer cannot be raised.

Gallery 21 has an axially lower side wall 27 which has a larger effective radial area than the axially upper side wall 27*a* of the gallery. The difference in radial area is conveniently achieved by forming sleeve 20 with two sections of different external diameters. The internal bore of the valve block within which the sleeve is journalled will have a corresponding stepped configuration.

The effective radial area of the end wall 31 of sleeve 20 is greater than the difference in effective radial areas of the walls 27 and 27*a*. Thus, when fluid at the same pressure is fed to chamber 30 and gallery 21 simultaneously, an axial force will be generated to move the sleeve upwards to bring ports 14 and 14*a* into register and hence to permit the flow of high pressure fluid from ports 14*b* and 14*c* into the cylinder for the lift stroke. The size of the force moving the sleeve axially is dependent upon the ratios of the radial components of the areas of shoulders 27 and 27*a* and of wall 31. Preferably, wall 31 has an effective radial area which is at least 10%, preferably from 200 to 1000%, greater than the difference between the areas of shoulders 27 and 27*a*. The wall 31 and shoulders 27 and 27*a* need not be truly radial as shown, but could be stepped, inclined to the axis of the sleeve or be curved. The term effective radial area is therefore used herein to denote the radial plan area presented by the wall or shoulder to the fluid acting on it.

In a typical operation, fluid under pressure is fed to port 14*c* and thence via gallery 21 and port 14*b* to accumulator 10 until the desired pressure to raise piston 2 within the cylinder 1 to the desired extent has been reached. Some of this fluid is then fed, e.g. by opening a suitable valve, to port 16 to cause sleeve 20 to be raised, bringing ports 14 and 14*a* into register. This will allow high pressure fluid to flow from ports 14*b* to 14*c* into the cylinder below the piston and thus drive the piston upwards. Fluid above the piston is displaced via duct 7, gallery 9 and ports 13*b* and 13*c* in the wall of the valve block into the low pressure accumulator 5 and into a reservoir for low pressure fluid (not show) respectively. The upward movement of sleeve 20 also puts ports 13 and 13*a* out of register, thus sealing the wall of the cylinder. The upward and downward travel of sleeve 20 is preferably limited by suitable stops. The stops can incorporate damping means to reduce shock deceleration of the sleeve.

The initial surge of high pressure fluid into the cylinder accelerates the piston upwardly. If the flow of high pressure fluid is shut off, the piston will continue to rise under the momentum of the weight which it carries. The flow is therefore cut off before the piston reaches its apogee by cutting off the pressure supply to chamber 30, e.g. by actuating the valve in the line linking ports 14*c* and 16. Port 16 is then linked to a low pressure point in the ram hydraulic circuit, e.g. to gallery 9 via the two way valve and port 13*c* as described above. This removes the pressure acting on the end wall 31 of sleeve 20, but pressure is maintained in gallery 21 and on walls 27 and 27*a*. By virtue of the larger area of wall 27, sleeve 20 is moved downward and ports 14 and 14*a* are taken out of register, thus cutting off the flow of high pressure fluid into the cylinder space below the piston. Ports 13 and 13*a* come into register and fluid can now flow from the cylinder space above the piston to below the cylinder via annular duct 7 and ports 13 and 13*a*, thus allowing the piston to decelerate. Excess fluid displaced by the piston flows via port 13*b* into the low pressure accumulator 5 and into the low pressure reservoir via port 13*c*, allowing the piston to move freely in cylinder 1 with substantially no interference from fluid in the cylinder and to continue its upward travel until its momentum is dissipated.

When the piston has reached its apogee, it begins to fall under gravity causing fluid to be displaced from below the piston via ports 13 and 13*a*, gallery 9 and duct 7 to above the piston, with the flow of fluid being supplemented from the low pressure accumulator 5. The free flow of fluid permits the piston to fall to its perigee, when the cycle is re-initiated by feeding high pressure fluid to port 16 to cause the sleeve 20 to be raised, again allowing high pressure fluid into the cylinder space below the piston.

In order further to aid free flow of fluid, the various radial ports in the valve block, the sleeve and the cylinder wall can be supplemented by further co-operating pairs of such ports, thus increasing the effective port area available and also promoting more uniform feed and flow of fluid through the valve assembly.

The valve block can be situated as shown in the drawing so that the high pressure fluid is fed to the cylinder below the piston. However, it is also possible to invert the ram from the orientation shown and to feed the high pressure fluid to the space above the full face of the piston.

The ram and sleeve can be made from any suitable material and the device of the invention offers a simplified construction without the need for complex sealing arrangements and separate pressure sources to move the valve sleeve. It is also possible to achieve a more compact and shorter valve assembly than with other designs. With the present design problems of leakage past seals is reduced and hence the operation of the valve requires comparatively small pressure differences for satisfactory operation, both of which prolong the active life of the valve assembly and its reliability.

The invention has been described above in terms of a pile driver. However, it is within the scope of the present invention to use the valving arrangement described above in other locations where it is desired to reciprocate an hydraulic ram repeatedly and rapidly, e.g. in a rock breaker or vibrating sieve or table separator.

I claim:

1. In a hydraulic ram of the type including a piston attached to an axially extending piston rod and journalled for axial movement within a cylinder defined within a cylinder wall under the influence of a fluid fed under pressure to said cylinder via a valving means for placing said cylinder in fluid flow communication with the fluid under pressure and to permit release of fluid from said cylinder upon completion of the stroke of said piston within said cylinder, the improvement wherein said valving means comprises:

a plurality of radial ports extending through said cylinder wall;

a valve block mounted at one end of said cylinder and having an end wall through which said piston rod is journalled;

a sleeve member mounted in sliding, sealing engagement with an outer surface of said cylinder wall, between said cylinder wall and said valve block, for axial movement with respect thereto;

said sleeve member having therethrough a plurality of radial ports adapted to align with respective said radial ports of said cylinder wall upon axial movement of said sleeve member with respect to said cylinder wall;

said sleeve member having formed therein a circumferential recess defined by two axially spaced radial walls, the effective radial area of one said radial wall located adjacent said end wall of said valve block being greater than the effective radial area of the other said radial wall;

a chamber defined within said valve block and limited by an end surface of said sleeve member, the effective radial area of said end surface being greater than the difference between said effective radial areas of said two radial walls;

inlet port means, extending through said valve block and in communication with said recess at all relative axial positions of said sleeve member with respect to said valve block, for supplying fluid under pressure into said recess and thereby for causing said sleeve member to move in a first axial direction within said valve block; and means for introducing fluid under pressure into said chamber and thereby for causing said sleeve member to move within said valve block in a second axial direction opposite to said first axial direction.

2. The improvement claimed in claim 1, further comprising fluid return means in communication with said cylinder for passing to a low pressure vessel fluid displaced from said cylinder by movement therein of said piston in a direction away from said one end of said cylinder, said fluid return means comprising a sleeve surrounding said cylinder wall and defining therewith an annular duct surrounding and substantially coaxial with said cylinder.

3. The improvement claimed in claim 1, wherein said ports of said cylinder wall comprise first and second axially spaced ports, said ports of said sleeve member comprise third and fourth axially spaced ports, said third port is connected to said recess, and said sleeve member is axially movable between a first position, whereat said first and third ports are in alignment and fluid under pressure supplied to said recess passes through said first and third ports into said cylinder, and a second position, whereat said second and fourth ports are in alignment and fluid is released from said cylinder through said second and fourth ports.

4. The improvement claimed in claim 3, wherein said means for introducing fluid under pressure into said chamber comprises a fifth port extending though said valve block into said chamber.

5. The improvement claimed in claim 4, further comprising two-position valve means operable in a first position for supplying fluid under pressure to said fifth port, and operable in a second position for releasing fluid pressure in said chamber.

6. The improvement claimed in claim 1, wherein said effective radial area of said end surface is at least 10% greater than said difference.

7. The improvement claimed in claim 1, wherein said effective radial area of said end surface is from 200% to 1000% greater than said difference.

8. The improvement claimed in claim 1, wherein said sleeve member includes two sections of different external diameters bounding said recess, and said valve block has a correspondingly stepped internal configuration.

9. A pile drive including a hammer reciprocated by means of a hydraulic ram as claimed in claim 1.

* * * * *